United States Patent [19]

Sirol

[11] Patent Number: 4,998,676

[45] Date of Patent: Mar. 12, 1991

[54] MILL

[76] Inventor: Graziano Sirol, Lot 31, Galvin Road, Llandilo, New South Wales 2760, Australia

[21] Appl. No.: 391,577

[22] PCT Filed: Jan. 15, 1988

[86] PCT No.: PCT/AU88/00028

§ 371 Date: Jun. 28, 1989

§ 102(e) Date: Jun. 28, 1989

[87] PCT Pub. No.: WO88/05340

PCT Pub. Date: Jul. 28, 1988

[30] Foreign Application Priority Data

Jan. 15, 1987 [AU] Australia ..... PH9882
Feb. 26, 1987 [AU] Australia ..... PI0549

[51] Int. Cl.[5] ..... B02C 13/286

[52] U.S. Cl. ..... 241/55; 241/79.1; 241/186 R; 241/189 R; 241/285 R

[58] Field of Search ..... 241/80, 97, 55, 189 R, 241/186 R, 186.4, 79.1, 285 R

[56] References Cited

U.S. PATENT DOCUMENTS

| | | | |
|---|---|---|---|
| 1,573,040 | 2/1926 | Crites | 241/186 R X |
| 1,608,183 | 11/1926 | Quante | 241/55 |
| 2,505,674 | 4/1950 | Knight | 241/186.4 X |
| 3,887,141 | 6/1975 | Francis . | |
| 4,607,799 | 8/1986 | Currie | 241/101.7 |
| 4,848,677 | 7/1989 | Rayner | 241/55 X |

FOREIGN PATENT DOCUMENTS

| | | | |
|---|---|---|---|
| 51752 | 3/1969 | Australia . | |
| 1323314 | 2/1963 | France | 241/186 R |
| 370971 | 8/1973 | U.S.S.R. . | |
| 645700 | 2/1979 | U.S.S.R. | 241/186 R |
| 843760 | 8/1960 | United Kingdom . | |

*Primary Examiner*—Mark Rosenbaum
*Attorney, Agent, or Firm*—Ladas & Parry

[57] ABSTRACT

A mill is used to break up ores or gravel in which gold particles are to be found. The mill comprises an outer casing in which an internal housing is located. Within the internal housing is a rotor which rotates at about 1000–15000 rpm. The rotor has cam surfaces on its circumference which impacts the ore and forces it onto a plurality of planar surfaces on the inside of the housing. The ore is broken up by the impacting and is then forced through an outlet passage into an outlet chamber where the heavier gold particles are removed from the lighter non-gold particles.

9 Claims, 3 Drawing Sheets

MILL

The present invention relates to milling machines, and in particular, to a milling machine which is suitable for impact treatment of gold bearing ore.

BACKGROUND ART

In the mining and milling of gold bearing ore, there are known machines which are used for impaction of the ore particles in a dry state.

These machines are basically drums into which the gold bearing ore is deposited. The drums have internally a plurality of rotor discs and hammers which are rotated at approximately 1000–1500 rpm, forcing the ore onto a series of plate members formed on the inside of the drum wall. The rotational speed of the rotor ensures that the ore particles are impacted at great speed. The different particles in the ore once broken down are able to be concentrated wherein the gold particles are concentrated at the bottom of the machine whilst the lighter materials are discharged.

OBJECT OF THE INVENTION

It is an object of the present invention to provide an improved mill which improves the milling process as described above.

DISCLOSURE OF THE INVENTION

According to one aspect of the present invention there is disclosed a mill comprising a substantially cylindrical housing having a rotor mounted therein, said housing having an inlet and an oulet, said housing having a transverse cross-sectional interior contour having a plurality of planar surfaces generally in a radial direction away from the longitudinal axis of said housing, arcurate surfaces joining the outer edge of one planar surface to the inner edge of the adjacent planar surface to form a plurality of impacting chambers around the periphery of the housing, said rotor having two cam surfaces, the outer edges of which are substantially adjacent the inner surface of the housing at its closest point, wherein the ore which is to be milled is inserted through the inlet into the housing and is impacted by the rotating cam surfaces and forced onto said planar surfaces by the rotation of said rotor and therefore being broken up in stages by the plurality of impacting chambers, the impacted ore being forced through an outlet chamber where the heavier particles are collected whilst lighter particles are exhausted, wherein an outlet passage between said impacting chamber and said outlet chamber prevents the broken up ore in said outlet chamber from re-entering said impacting chamber.

BRIEF DESCRIPTION OF THE DRAWINGS

The present invention will now be described with reference to the drawings in which.

BEST MODE OF CARRYING OUT THE INVENTION

Figure 1:
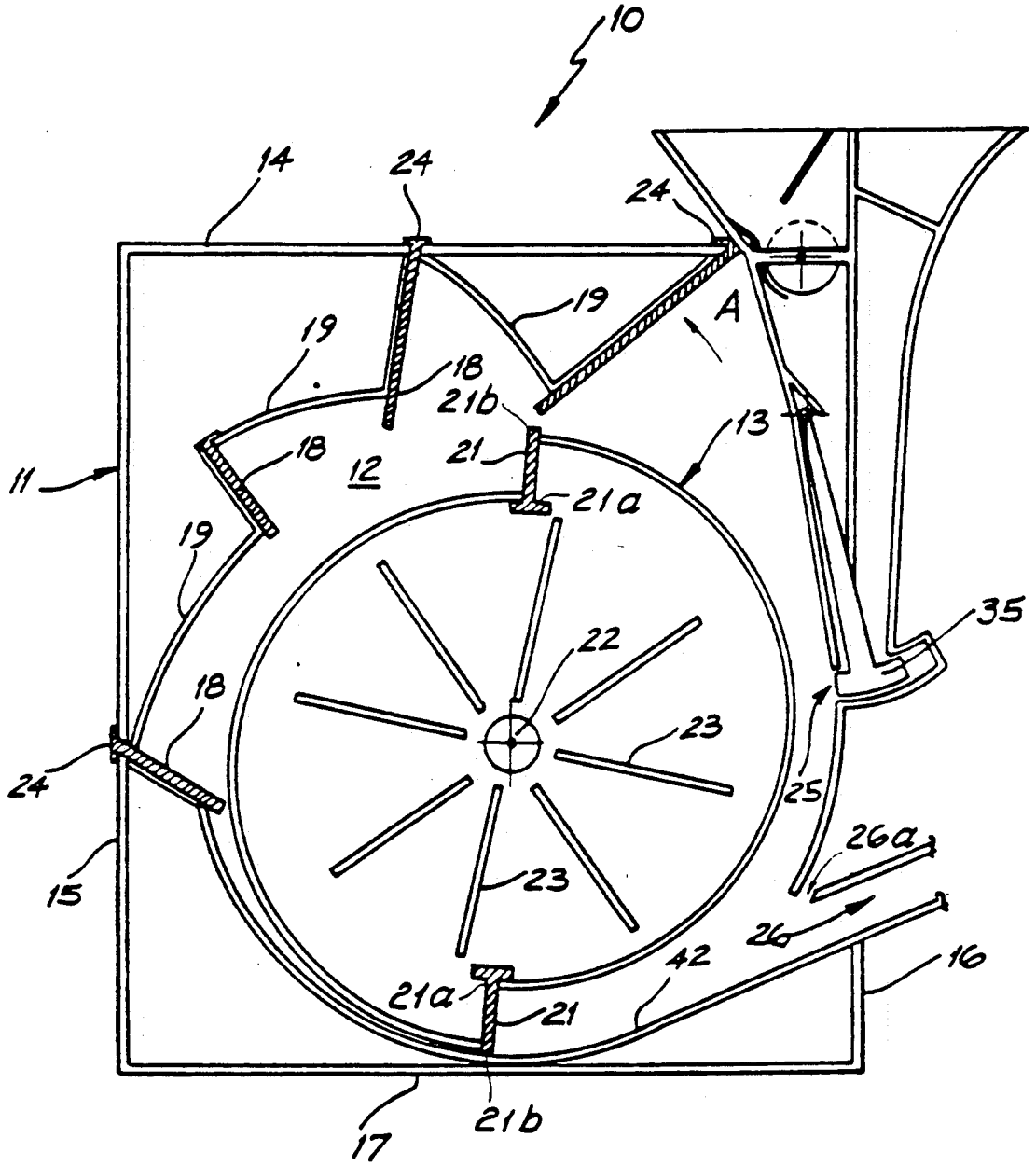
FIG. 1 is a transverse cross-sectional view of the mill of a preferred embodiment of the present invention.
Figure 2:
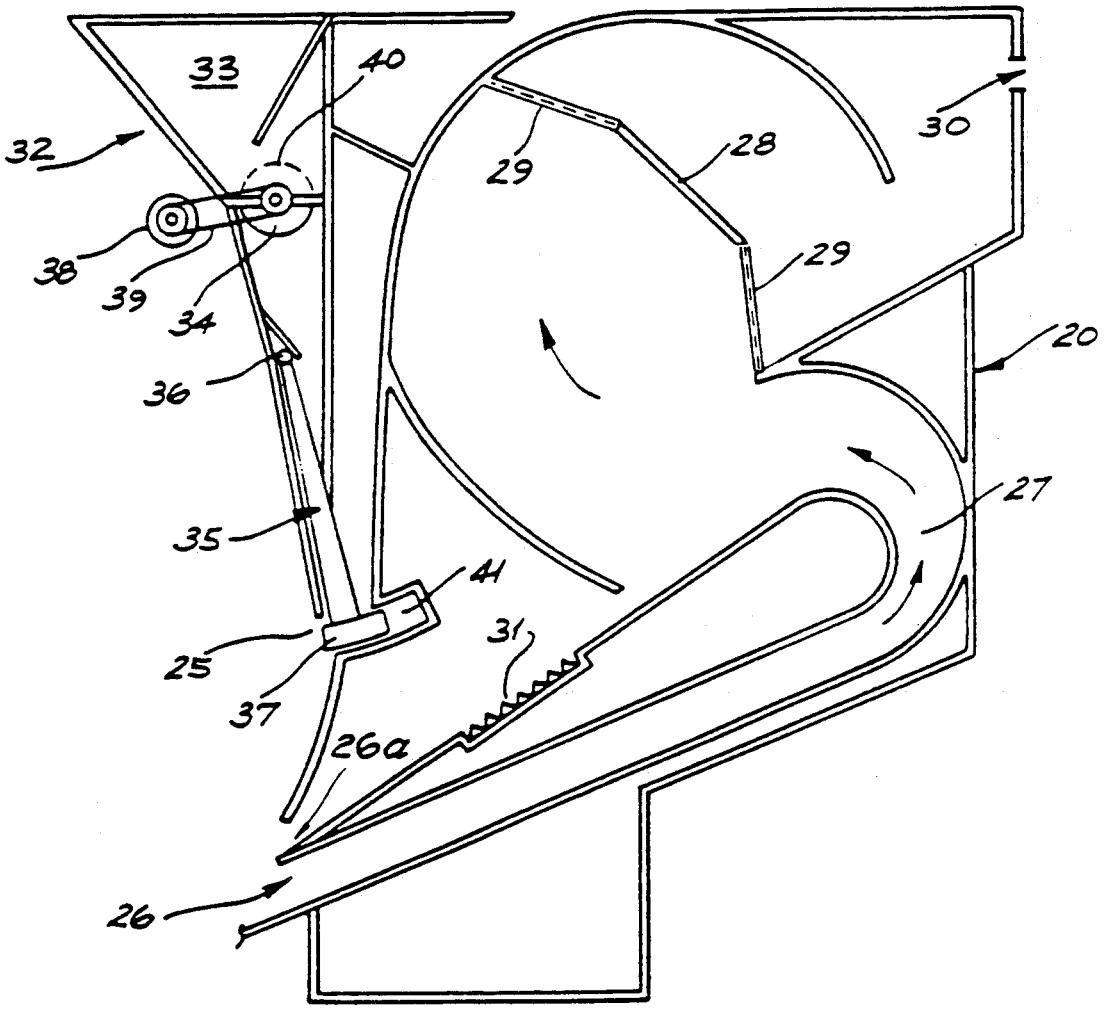
FIG. 2 is a transverse cross-sectional view of the inlet and outlet chambers of the mill of the preferred embodiment.
Figure 3:
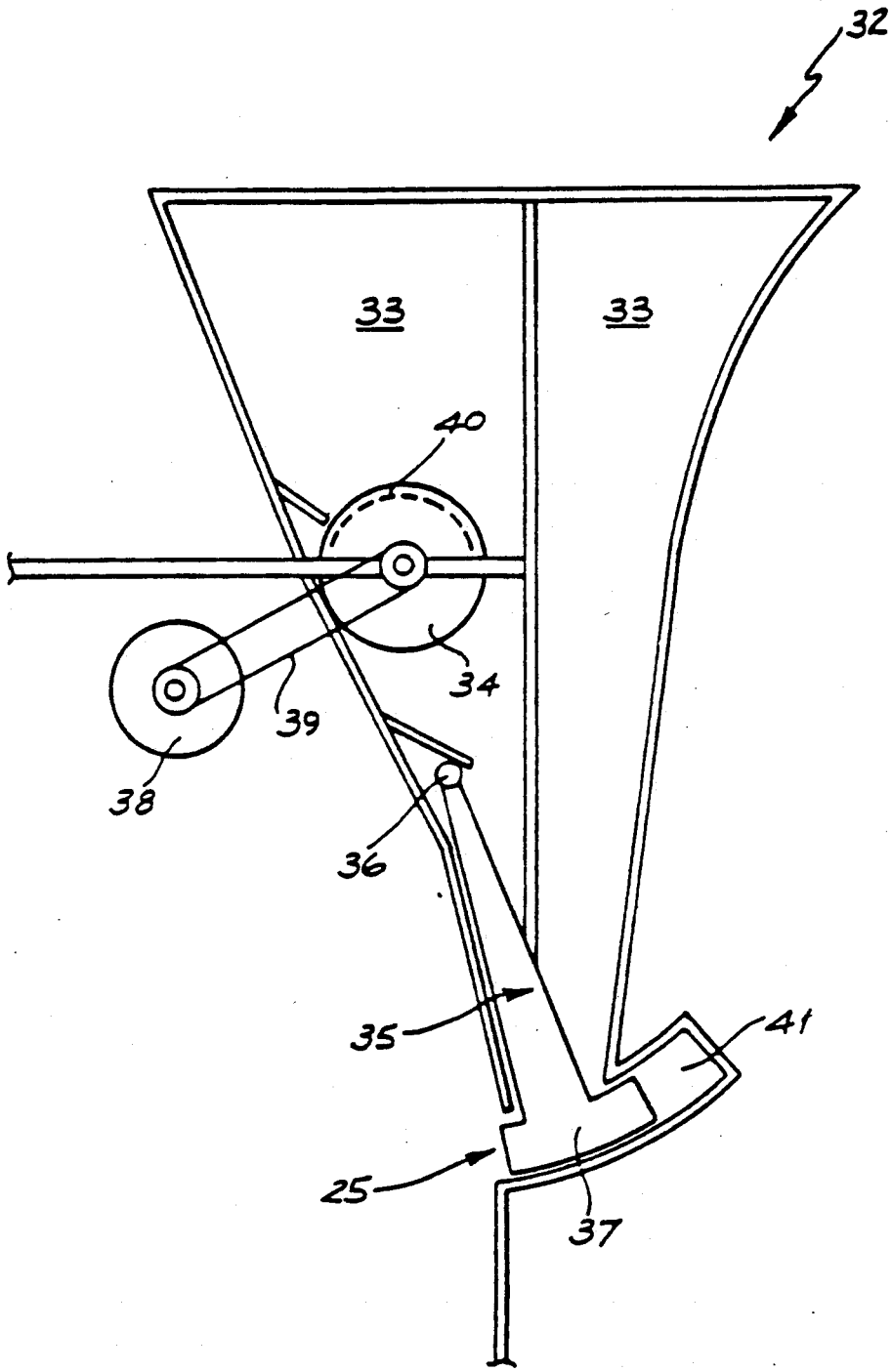
FIG. 3 is a detailed schematic view of the input system as illustrated in FIG. 2.

The mill 10 as illustrated in the drawings consists of a rectangular boxed casing 11 having an internal housing 12 with a rotor 13 mounted therein. The rotor 13 is driven in an anti-clockwise direction by a motor via a fan belt drive (not illustrated). The rotor 13 rotates in bearings (not illustrated) located on the end panels (not illustrated) of the casing 11. The casing 11 has a top panel 14, two lateral panels 15 and 16 and a base 17 as well as the end panels.

The inner surface of the internal housing 12 has a plurality of planar surfaces 18 which are substantially perpendicular to the circumference of the rotor 13 and extend longitudinally inside the housing 12. These surfaces 18 are connected by arcuate surfaces 19 to form a continuous surface of the interior of the housing 12.

The planar surfaces 18 of the internal surface of the housing 12 are made from hardened steel and are bolted into place. After use and the planar surfaces 18 are worn, they are able to be removed through openings 24 in the casing 11.

The circumferential surface of the rotor 13 comprises two cam surfaces 21 which are in a plane in the radial direction from the axis of rotation 22. A pair of slotted grooves **21*a* are located in the rotor 13 to hold the cam surface 21 made from hardened steel. Similarly to the planar surfaces 18 the cam surfaces 21 can be replaced when worn. At the ends of the rotor 13 are a plurality of fans 23 which protrude therefrom. The blades of the fans 23 are directed in a substantially radial direction from the axis of rotation 22**.

An inlet and outlet chamber 20 is connected to the milling chamber 2 by the inlet passage 25 and the outlet passage 26. The chamber 20 comprises a winding path 27, baffles 28, perforated flaps 29 and an exhaust 30. The chamber 20 further comprises a settling tray 31 and a re-entry passage **26*a*. The re-entry passage 26*a* is such that the crushed ore can go through the outlet passage 26 into the winding path 27** again.

The inlet passage 25 is connected to an ore input system 32. The system 32 comprises an inlet hopper 33, a measuring inlet cylinder 34 and a hammer 35. The hammer 35 pivots around a axis 36 and has a head 37 which moves from an input position to a rest position in a recess 41. The system 32 operates in the manner that a certain amount of ore is to be input into the inner housing 12 per operation of the hammer 35. The ore which is in the hopper 33 is let into the cylinder 34 as it is rotated by an adjustable speed control motor 38 which rotates it by means of a belt system 39. The cylinder 34 has a plurality of openings 40 which allows the ore to enter the cylinder 34 and as it rotates empties the ore into the inlet passage 25.

As the ore is allowed to drop into the inlet passage 25 the hammer 35 is synchronously moved into the rest position into the recess 41. As the rotor 13 rotates inside the chamber 12 and the cam surfaces 21 are adjacent and aligned with inlet passage 25 the hammer 35 synchronously forces the ore into the chamber 12 where it is immediately impacted by the came surface 21. The input of the ore is synchronised to be timed with the rotation of the rotor 13.

Alternatively if synchronised feeding or inputing of the ore is not required due to the nature of the ore the ore can be gravity fed with the hammer 35 in its rest position.

In operation, the rotor 3 is rotated at approximately 1200 rpm and the ore which is inputed into and impacted by the cam surfaces 21 of the rotor 13. The ore is forced in an anti-clockwise direction indicated by the arrow against the planar surfaces 18. The particles of the ore then fall from these surfaces 18 and are once again impacted by the following cam surface 21 onto another planar surface 18. The particles at the lower half of the chamber 12 are all impacted by the cam surfaces 21 as the outer edge **21*b* of the cam surface 21 is adjacent the interior surface 42 of the chamber 12. At the outlet passage 26 all the particles of ore are forced through into the chamber 20**.

The ore is forced by the rotation of the rotor through the winding path 27 and around the baffles 28 and through the perforated flaps 29 which can be changed due to the nature of the ore being broken up. If the particles of ore are light enough they are exhausted through the exhaust 30, to be formed into a heap or into containers (not shown). The exhausted particles of ore are then treated in the normal way to extract any gold particles. If the particles of ore are heavy they will contact the baffles 28 and fall downwards. The heavier particles, some of them containing gold is then directed towards the tray 31. Any heavy gold particles are caught in the tray. The particles which are not caught by the tray are directed through the re-entry passage **26*a* into the winding path 27. The particles do not re-enter the milling chamber tube due to the centrifugal force of the movement of the rotor 13**.

This process is continuous as extra ore is inputted into the chamber 12 via the hopper 26 until sufficient material is collected from the outlet chamber 20.

The fans 23 on the rotor 3 are used to induce a draught to maintain all the particles inside the chamber 12 and to keep the particles away from the bearings.

The foregoing describes only one embodiment of the present invention, and modification obvious to those skilled in the art can be made thereto without departing from the scope of the present invention.

INDUSTRIAL APPLICABILITY

The above described embodiment of the present invention is applicable to the breaking up of ore or gravel which may contain gold particles. The mill is used to separate the gold from the other materials when the ore is in a dry condition.

I claim:

1. A mill comprising a substantially cylindrical housing having a rotor mounted therein, said housing having an inlet and an outlet and having a transverse cross-sectional interior contour with a plurality of planar surfaces generally in a radial direction away from the longitudinal axis of said housing, and with arcuate surfaces joining the outer edge of one planar surface to the inner edge of the adjacent planar surface to form a plurality of impacting chambers around the periphery of the housing, said rotor having at least two cam surfaces, the outer edges of which are substantially adjacent the inner surface of the housing at its closest point, wherein the ore which is to be milled is inserted through the inlet into the housing where it is impacted by the rotating cam surfaces and forced onto said planar surfaces by the force of the moving cam surface, wherein the ore is broken up in stages by the plurality of impacting chambers and is then forced through an outlet chamber having a collecting tray where the heavier particles are collected in the collecting tray whilst the lighter particles are exhausted, wherein an outlet passage between said impacting chamber and said outlet chamber in combination with centrifugal force caused by the rotor movement prevents the broken up ore in said outlet chamber from re-entering said impacting chamber.

2. A mill as claimed in claim 1 wherein said planar surfaces are made from hardened steel and are replaceably attached to the inner surface of the housing, and said cam surfaces are made from hardened steel and are replaceably attached to the rotor being anchored in a slit formed adjacent said cam surfaces.

3. A mill as claimed in claim 2 wherein said housing is located within an outer casing which has openings through which said planar surfaces are able to be inserted or removed when the surfaces are worn.

4. A mill as claimed in claim 2 wherein said rotor has a fan means located at its ends so as to induce a draft to ensure the ore remains in the impacting chambers.

5. A mill as claimed in claim 1 wherein said outlet chamber has an interval air flow path through which said particles of ore travel by force of said cam surfaces on said rotor, said flow path having a plurality of baffles to interupt said air flow thus allowing the heavier particles to fall and to be collected in the collecting tray.

6. A mill as claimed in claim 1 wherein the ore is fed into said housing via a gravity feed system.

7. A mill as claimed in claim 1 wherein the ore is fed synchronously into said housing by means of a feed hammer timed to operate as said cam surface is adjacent said inlet.

8. A mill as claimed in claim 7 wherein a quantity of the ore is measured by a variable input means before it is fed into said housing.

9. A mill as claimed in claim 1 wherein said mill is portable.

* * * * *